US005642877A

United States Patent [19]

Green

[11] Patent Number: 5,642,877

[45] Date of Patent: Jul. 1, 1997

[54] PAPER SHEET FEEDING APPARATUS AND GATE FORMING MEMBER THEREFOR

[76] Inventor: Ronald J. Green, E4465 Kinnamin Rd., Reedsburg, Wis. 53959

[21] Appl. No.: 606,213

[22] Filed: Feb. 23, 1996

[51] Int. Cl.[6] ..... B65H 3/04

[52] U.S. Cl. ..... 271/35; 271/124

[58] Field of Search ..... 271/35, 124, 125, 271/121

[56] References Cited

U.S. PATENT DOCUMENTS

| | | | |
|---|---|---|---|
| 3,933,350 | 1/1976 | Mignano | 271/125 |
| 4,529,187 | 7/1985 | Einem et al. . | |
| 4,603,848 | 8/1986 | Markgraf et al. | 271/125 |
| 4,607,832 | 8/1986 | Abe . | |
| 4,720,960 | 1/1988 | Green . | |
| 4,858,907 | 8/1989 | Eisner et al. . | |
| 4,991,831 | 2/1991 | Green . | |
| 5,143,365 | 9/1992 | Green . | |
| 5,244,198 | 9/1993 | Green . | |

*Primary Examiner*—H. Grant Skaggs

*Attorney, Agent, or Firm*—Bell, Seltzer, Park & Gibson, P.A.

[57] ABSTRACT

A paper sheet feeding apparatus which includes a gate forming member positioned above the upper run of the sheet feeding belts and so as to define a nip therebetween. The gate forming member comprises a cylindrical roll having a plurality of annular grooves extending about the circumference thereof, and an elastomeric ring disposed in each of the grooves. The outer peripheral surface of the roll also includes a relief extending axially along the length thereof and positioned so as to oppose the nip, and the rings are sized so as to be exposed on the portion of the outer peripheral surface defined by the relief. In operation, the lowermost sheet is fed by the sheet feeding belts through the nip without engaging the exposed rings, and without significant frictional resistance, while the sheet immediately above the lowermost sheet engages the exposed rings and is retarded in its advance by its engagement with the rings.

14 Claims, 3 Drawing Sheets

PAPER SHEET FEEDING APPARATUS AND GATE FORMING MEMBER THEREFOR

BACKGROUND OF THE INVENTION

The present invention generally relates to a paper sheet feeding apparatus and more particularly to an apparatus for serially feeding flat sheets of paper from the bottom of a vertical stack of such sheets and so as to permit subsequent processing of each individual sheet.

Generally, sheet feeding machines capable of high speed feeding are relatively complicated, and require a large number of complex and interrelated moving parts which are subject to wearing out and failure.

U.S. Pat. No. 4,991,831 discloses an improved sheet feeding apparatus wherein a gate forming member is positioned above the upper run of a belt feeding system so as to define a nip therebetween. The gate forming member mounts a plurality of elastomeric rings in eccentric grooves, so that the rings are not exposed on the side of the roll facing the stack of sheets being fed, but the rings are exposed at the nip. The nip is sized for permitting the lowermost sheet of the stack to pass freely through the nip, while the sheet immediately above the lowermost sheet is retarded by its frictional engagement with exposed portions of the rings.

While the sheet feeding apparatus as disclosed in the '831 patent represents a significant advance in the art and has enjoyed commercial success, the manufacturing cost associated with the formation of eccentric grooves in the roll is relatively high. Also, the mechanism for adjusting the nip opening size to accommodate paper sheets of varying thickness requires manual adjustment in all cases, and is not susceptible to an automatic operation.

It is accordingly an object of the present invention to provide a sheet feeding apparatus of the described type having a reduced manufacturing cost, and which is able to permit almost automatic adjustment of the nip opening size to accommodate sheets of paper of different size and weight.

SUMMARY OF THE INVENTION

The above and other objects and advantages of the present invention are achieved by the provision of a gate forming member which comprises a generally cylindrical roll defining a central axis and an outer peripheral surface which is concentric to the central axis. The outer peripheral surface has a plurality of annular grooves extending about the circumference thereof, and the annular grooves are concentric to the central axis. A relief extends axially along the length of the outer peripheral surface so as to intersect each of the grooves, and a ring is disposed in each of the grooves. The rings are composed of an elastomeric material having a higher coefficient friction than the material of the roll, and the rings are sized so as to be exposed on the portion of the outer peripheral surface defined by said relief, and so as to lie entirely within the grooves in the remaining portion of the outer peripheral surface and be non-exposed.

The gate forming member is mounted to a mounting bracket of the machine frame by an arrangement wherein the roll is positioned above the upper run of a belt delivery system so as to define a nip therebetween, and with the relief and the exposed portions of the rings being positioned at the nip. The mounting arrangement also permits the dimension of the nip to be adjusted. Thus the gate forming member may be adjustably positioned so that the lowermost sheet is free to pass through the nip without significant engagement with the roll and thus without significant frictional resistance, while the sheet immediately above the lowermost sheet engages the exposed portions of the rings and is frictionally engaged thereby. The mounting arrangement comprises a rod fixed to the roll at a central portion thereof and such that the rod extends radially upwardly from the nip, and means interconnecting the rod to the mounting bracket so as to permit limited movement therebetween and the dimension of the nip to be adjusted. A spring surrounds the rod for biasing the roll toward the nip and for permitting limited movement of the roll away from the nip and against the force of the spring.

The mounting arrangement more specifically comprises a caliper assembly which includes a knob threadedly mounted to the end of the rod opposite the roll, such that rotation of the knob in one direction causes the rod and the roll to be lifted away from the nip and against the biasing force of the spring, and rotation in the other direction permits the rod and the roll to move toward said nip under the force of the spring. The caliper assembly further includes a pair of caliper jaws slideably mounted on the rod between the mounting bracket and the knob for permitting the knob and thus the rod and the roll to be lifted and held at a selected distance above said upper run of the belt delivery system when a shim is inserted between the caliper jaws.

BRIEF DESCRIPTION OF THE DRAWINGS

Some of the objects and advantages of the present invention having been stated, others will appear as the description proceeds, when taken in conjunction with the accompanying drawings, and which.

DETAILED DESCRIPTION OF THE PREFERRED EMBODIMENTS

Figure 1:
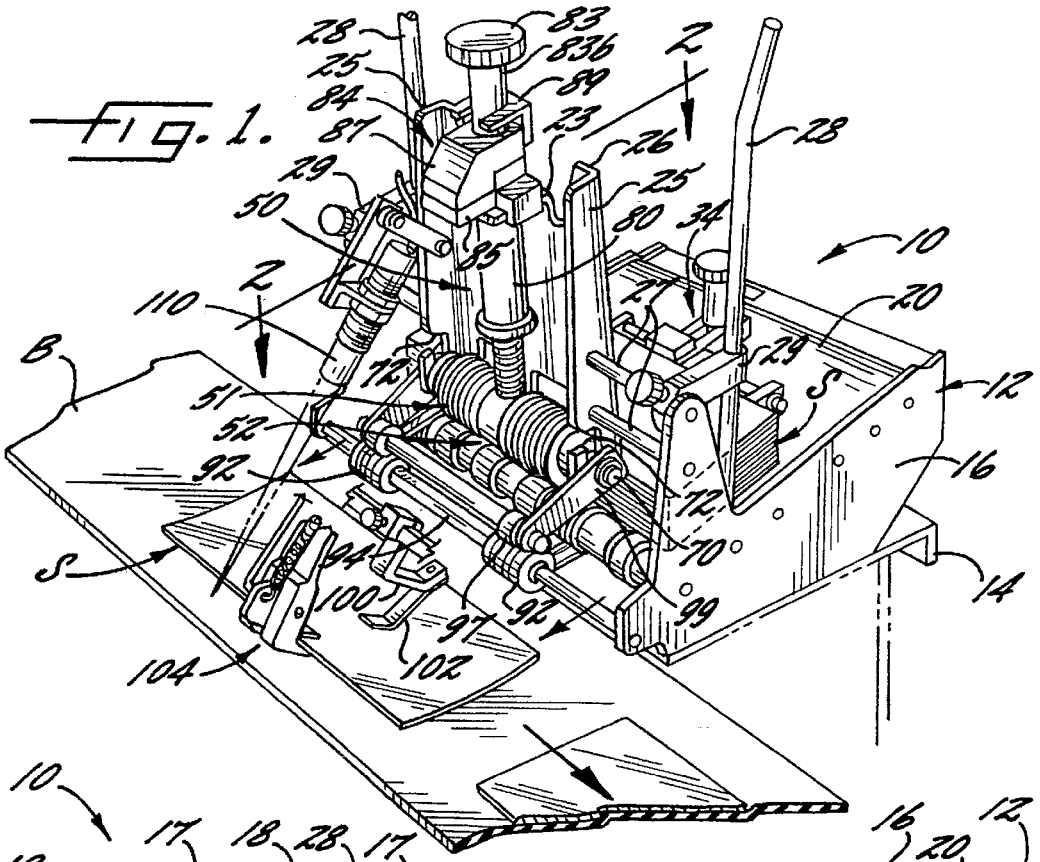
FIG. 1 is a perspective view of a sheet feeding apparatus which embodies the features of the present invention.

Referring more particularly to the drawings, an apparatus for serially feeding sheets of paper from a bottom of a generally vertically stack of such sheets, and which embodies the features of the present invention, is indicated generally at 10. The apparatus 10 is shown in use as a part of sheet feeding system, and wherein the sheets S are fed laterally from the bottom of the stack onto a moving conveyor belt B, and So that the sheets may be subsequently collated with other sheets, or placed in mailing envelopes, in a conventional manner.

The apparatus 10 comprises a rigid frame 12 which includes a base plate 14, a pair of upright side plates 16 which are joined to the base plate, and a number of transverse rods 18 extending between and interconnecting the side plates. The transverse rods 18A and 18B are mounted by means of bearings 17 to the side walls, note FIG. 2, so as to permit the free rotation thereof. The remaining transverse rods are fixedly mounted to the side walls. Also, the frame includes a rear cover plate 20 which extends between the side plates 16 and is connected thereto at the rear portion of the frame.

Figure 4:
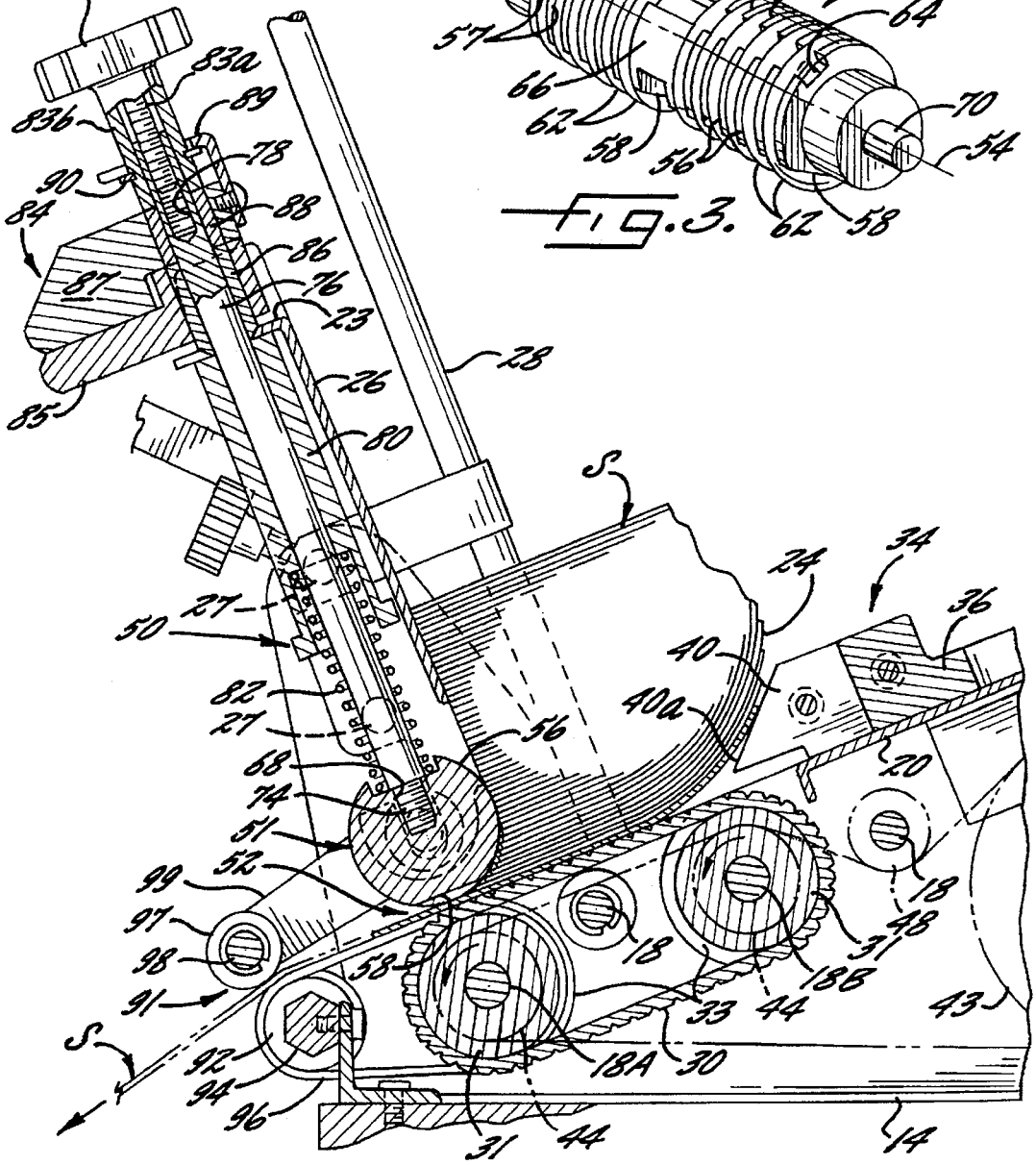
FIG. 4 is a fragmentary side sectional view of the gate forming member and associated components of the apparatus taken substantially along the line 4—4 of FIG. 2.

The apparatus 10 further comprises means for supporting a generally vertical stack of rectangular sheets S of paper. As best seen in FIG. 4, the supported stack defines a forward side 22 composed of aligned forward edges of the sheets, as well as the opposite rear side 24 composed of the aligned rearward edges of the sheets. The forward side of the stack is supported in the forward direction by a generally vertically extending front support plate 26. The front support plate includes inturned opposite sides 25, which are fixedly secured to the frame by transverse rods 27 (FIG. 1). The upper portion of the support plate includes a generally horizontal mounting bracket 23 having a forwardly extending slot 23*a* for the purposes described below.

The means for supporting the vertical stack of paper sheets also includes a pair of vertical rods 28 which support respective opposite ends of the stack, and the rods are each mounted to the frame by an arm 29 which is fixed to the associated vertical rod, and which is coupled to a transverse rod 27 by an opening which receives the transverse rod, and a threaded member, so as to permit the separation of the rods 28 to be laterally adjusted. Thus the rods are able to accommodate stacks of sheets of different length therebetween.

The stack supporting means further includes endless belt means, and which comprises, in the illustrated embodiment, three endless belts 30, and a pair of aligned support rolls 31 (FIG. 4) mounted on respective ones of said support shafts 18A, 18B, for mounting each of said endless belts. A plurality of drive rolls 33 are mounted on each of said support shafts 18A, 18B, with one of said drive rolls being positioned on each shaft between adjacent endless belts. The diameter of the support rolls 31 is less than the diameter of the drive rolls 33 so that said drive rolls have an outer surface which is substantially coextensive with the outer-surface of said endless belts. The support rolls 31 are positioned such that the three belts 30 define coplanar upper runs which extend across the bottom of the stack. The belts 30 bridge the space between the drive rollers 33, and the belts 30 and drive rollers 33 serve to convey the sheets forwardly to the nip area in the manner further described below.

The stack supporting means also includes a rear support member 34 which is positioned above the upper runs of the three belts and below the rear side of the stack of sheets. The rear support member includes a bracket 36 which is releasably connected to the rear cover plate 20 by means of a threaded member 37 which extends through a slot 38 in the bracket and which threadedly engages a selected one of three threaded openings 39 in the rear cover plate. The bracket also includes four forwardly extending fingers 40 which underlie the rear side of the stack of sheets. The fingers each have an inclined forward edge 40*a* as best seen in FIG. 4, so as to lift the rear side of the stack upwardly from the upper run of the three belts. The lateral position of the bracket and the fingers is thereby adjustable so as to permit accommodation of sheets of differing widths.

The three belts 30 and drive rollers 33 are rotated by a drive system 42 so that the upper runs move in a right to left (or forward) direction as seen for example in FIG. 4. This drive system includes an electric motor M which is mounted to the frame of the apparatus beneath the rear cover plate, and which includes an output drive pulled 43. The drive system further includes drive pulleys 44 fixedly mounted on each of the two transverse rods 18A and 18B, and an endless drive belt 46 entrained about the three drive pulleys. Also a follower pulley 48 is provided which engages the belt at a location between the pulleys 43 and 44 to ensure proper and firm engagement therewith.

The apparatus 10 further includes a stationary gate forming member 50 positioned above the upper runs of the three belts, and adjacent the forward side of the stack of sheets, and so as to define a nip 52 between the gate forming member 50 and the upper runs of the belts 30 and the forward drive rollers 33 on the rod 18A. In the illustrated embodiment, the gate forming member comprises a generally cylindrical roll 51 defining a central axis 54 and an outer peripheral surface 56 which is concentric to the central axis.

Figure 5:
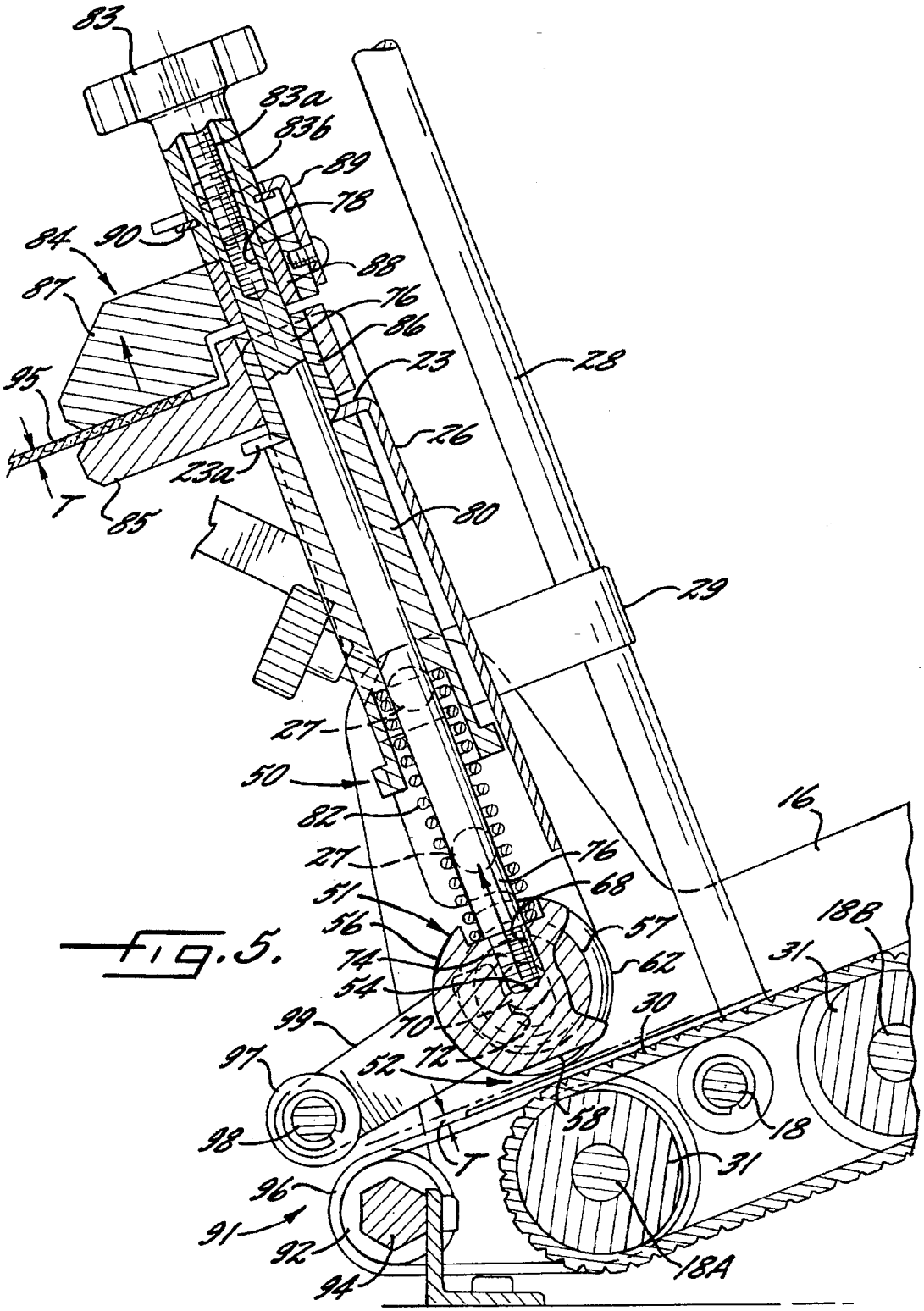
FIG. 5 is a view similar to FIG. 4 and illustrating the gate forming member in an adjusted position.

The outer peripheral surface has a plurality of annular grooves 57 extending about the circumference thereof, with the grooves being concentric to the central axis. Also, the outer peripheral surface has a relief 58 extending axially along the length thereof and which is positioned to generally oppose the nip 52. As best seen in FIGS. 4 and 5, the relief is preferably in the form of a chordal line when the roll is viewed in cross section, so that it can be formed by a simple milling operation, and the relief has a maximum depth which is at least equal to about one half the depth of the grooves 57.

The roll 51 further includes a ring 62 of elastomeric material disposed in each of the grooves, with the rings having a higher coefficient of friction than that of the material of the roll. Also, the rings are sized so as to be exposed on the portion of the outer peripheral surface defined by the relief 58, note (FIG. 5), while lying entirely within the grooves 57 in the remaining portion of the outer peripheral surface so as to be non-exposed. Thus, the rings 62 are not exposed to engage the-paper sheets at any portion of the peripheral surface of the roll except at the relief 58.

Figure 3:
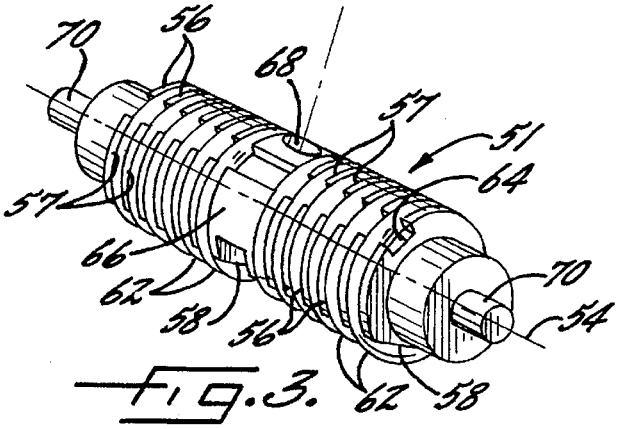
FIG. 3 is a perspective view of the cylindrical roll of the gate forming member of the present invention.

In a preferred embodiment, the roll is formed of an acetal plastic or metallic material having a coefficient of friction of about 0.15–0.35 and the rings are formed of an elastomeric material having a coefficient of friction of about 0.5–0.7. As those skilled in the art are aware, other materials for the roll and rings may be used. Also, as seen in FIG. 3, the roll may include an axially extending channel 64 in the forwardly facing portion of the outer peripheral surface, which facilitates engagement of the rings and removal or rotational adjustment thereof.

The apparatus includes means for mounting the roll 51 so as to permit the dimension of the nip 52 between the roll and endless belts 30 and rollers 33 to be adjusted. The ability to adjust the nip allows for the single feeding of sheets of various thicknesses. More particularly, the roll 51 includes a central portion 66 and a threaded radial opening 68 which extends into the central portion on the side opposite the relief 58, note FIGS. 4 and 5. Also, the opposite ends of the roll include coaxial mounting posts 70, which are received with respective ones of the vertically extending slots 72 in the sides 25 of the front support plate 26. A threaded rod 74 is threadedly received in the opening 68, and the threaded rod includes an upper portion 76 which extends through the slot 23*a* in the mounting bracket 23. This upper end portion is formed with an internally threaded axial bore 78, and a sleeve 80 and a spring 82 coaxially surround the rod below the mounting bracket 23 of the support plate 26, with the sleeve having an upper end which engages the underside of the bracket 23. The spring is under compression, so as to bias the roll 51 downwardly with respect to the bracket. This downward movement is limited by a caliper assembly 84 which is mounted on the rod above the mounting bracket 23, and which includes a control knob 83 which has a threaded member 83*a* engaged in the bore 78 at the upper portion of the rod, and an outer concentric sleeve 83*b*. As will become apparent, rotation of the control knob 83 tends to raise or lower the roll with respect to the mounting bracket 23, and to thus change the vertical dimension of the gap at the nip 52 formed between the roll 51 and the endless belts 30 and rollers 33. Also, the spring 82 will be seen to bias the roll toward the nip and it permits limited upward movement of the roll away from the nip and against the force of the spring, When an upward force is exerted on the knob 83.

The caliper assembly 84 also permits the knob and thus the rod 74 and the roll 51 to be lifted as a unit and held at a selected distance from the nip. More particularly, the caliper assembly further includes a lower caliper jaw 85 which includes a bushing 86 fixed thereto and which is slideably received on the upper portion 76 of the rod 74. The bushing 86 is normally seated in the slot 23*a* of the mounting bracket 23 in the operative position of the gate forming member as seen in FIGS. 4 and 5. The lower caliper jaw 86 also includes an integral angled tab 85*a* (FIG. 1) on each of its sides, with the tabs being positioned to overlie the edges of the mounting bracket 23 and so as to prevent rotation of the jaw 85 when the knob 83 is rotated.

The caliper assembly further comprises an upper caliper jaw 87 which includes a bushing 88 fixed thereto and which is also slideably received on the upper portion 76 of the rod 74. The upper caliper jaw 87 is also fixed with respect to the knob 83 by means of a bracket 89 and retaining ring 90, so as to preclude relative movement in the direction of the axis of the rod while permitting the knob to be rotated with respect to the rod 74. Also, the jaws 85 and 87 have angular opposing faces as seen in FIGS. 4 and 5, to preclude relative rotation therebetween. Thus, upon rotation of the knob, the rod 74 is lifted or lowered with respect to the two caliper jaws 85, 87, with the two caliper jaws remaining fixed on the mounting bracket 23, and the force of the spring 82 acts to bias the two caliper jaws toward each other.

The upper and lower caliper jaws are positioned so as to overlie each other, and upon the insertion of a shim 95 of predetermined thickness T between the caliper jaws as seen in FIG. 5, the caliper jaws are maintained in a spaced apart relation and the nip is held open by a corresponding distance.

The above-described mounting means for the roll 51 also permits the quick release and removal of the gate forming member 50 which includes the roll 51, rod 74, sleeve 80, caliper jaws 85, 87, and control knob 83, to thereby facilitate replacement of the rings 62 upon their becoming worn. More particularly, the gate forming member may be released and removed by lifting upon the knob 83 so that the mounting posts 70 of the roll 51 are removed from the slots 72 in the sides 25 of the plate 26, and then sliding the rod 74 forwardly from the slot 23*a* of the mounting bracket 23.

Figure 2:
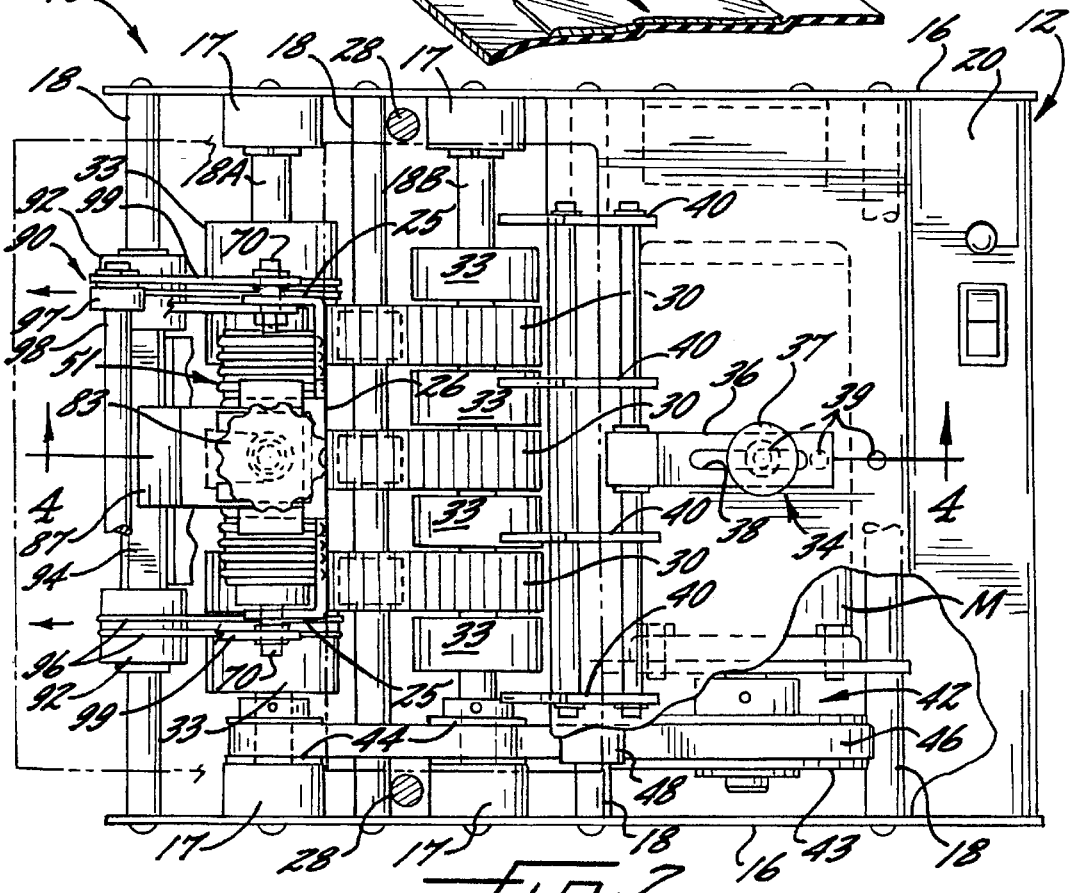
FIG. 2 is a top plan view of the apparatus viewed along the line 2—2 in FIG. 1.

The apparatus further comprises sheet guide means 91 positioned downstream of and in registry with the nip for guiding the sheets forwardly after advancing through the nip. This sheet guide means, as seen in FIGS. 1–2, comprises two laterally spaced apart guide roller segments 92 which are mounted for rotation about the transverse rod 94, which is disposed parallel to the axes of the rods 18A and 18B. The upper portions of the guide roller segments are substantially coplanar with the upper run of the three endless belts 30, and a transmission is provided for operatively connecting the drive motor with the guide roller segments, so that the guide roller segments rotate at a peripheral speed corresponding to the speed of the three endless belts 30 and rollers 33. This transmission comprises a pair of guide belts 96 entrained about each support roll segment and the adjacent roller 33 with the guide belts having an upper run which is substantially coplanar with the upper runs of the three endless belts.

The sheet guide means 91 further comprises a paie of clamping roller segments 97, which are mounted on a support rod 98 which is positioned along an axis parallel to the axis of the guide roller segments 92 so that the clamping roller segments rest upon the peripheral surface of respective ones the guide roller segments. The clamping roller segments are freely rotatable, and the rod is supported by means of a pair of lever arms 99 which are pivotally mounted on respective posts 70 of the roll 51, as best seen in FIG. 1, and so that the clamping roller segments rest from their own weight upon the guide roller segments 92.

To assist in properly delivering the sheets onto the conveyor belt B, at least one sheet guiding member 100 is positioned downstream of the nip and downstream of the sheet guiding means as seen in FIG. 1. The sheet guiding member is fixedly mounted above the conveyor belt, and it includes a downwardly inclined surface portion 102 for engaging the leading edge of each sheet and guiding the same towards an oscillating gripper 104 of conventional design. More particularly, the gripper is programmed to oscillate toward the clamping roller segments to engage the leading edge of each sheet, and then oscillate rearwardly while engaging the leading edge and so as to accurately position the sheet on the conveyor belt B.

A photocell 110 is mounted on the apparatus to control the operation thereof. More particularly, in one possible mode of operation, when no sheet is detected by the photocell, the motor is actuated so as to rotate the endless belts 30 and drive rollers 33 a controlled distance which is calculated to deliver a single sheet through the nip. Concurrently, the gripper 104 is oscillated toward the apparatus to catch the leading edge of the sheet, and then oscillate rearwardly to its release position. The advancing sheet is detected by the photocell 110, which holds the motor deactivated until the sheet is moved by the conveyor beyond the site of the photocell. The sequence is then repeated to deliver another sheet from the stack onto the conveyor belt.

Alternatively, the illustrated embodiment of the apparatus can be operated in a continuous fashion without the photocell or only using the photocell as a counter. In this mode, the speed of the drive means 42 and the conveyor belt B speed must be coordinated so that sheets fall on the belt at desired intervals.

During the sheet feeding operation, it is preferred that the gap formed at the nip 52 be adjusted such that the lowermost sheet of the stack is free to pass through the nip 52 without engaging the rings 62 and thus without significant frictional resistance, while the sheet immediately above the lowermost sheet engages the exposed rings 62 of the roll 51 and is retarded by the increased frictional resistance provided by the rings. Thus the sheets above the lowermost sheet are held substantially stationary in the stack. Also, the rear support member 34 is positioned so as to lift the rear side of the stack from the upper run of the three endless belts 30 and rollers 33 such that the sheets in the stack above the lowermost sheet will only contact the upper run after the lowermost sheet has entered the nip. Thus the sheets are reliably fed in a serial manner from the bottom of the stack and until all of the sheets in the stack have been delivered onto the conveyor belt B.

The apparatus may also be operated to provide for the shingling of the sheets being fed. In this regard, it will be understood that the peripheral surface on the side of the roll 51 facing the stack is smooth so as to offer very little resistance as the sheets form around the surface and are guided to the nip 52. The nip is adjusted to allow the lowermost sheet to freely pass between the rings 62 and the lower drive belt 30 and rollers 33. The second sheet which is immediately above the lowermost sheet meets the resistance of the rings at the nip and is held in place until the lowersheet has fed out enough to allow contact with the underlying drive belt system which then drives the second sheet forward into a tight fit in the nip. The trailing edge of the lowermost sheet passes the nip and the second sheet continues to drive forward, thus allowing shingling. This system makes the feeder very tolerant of open edge leading products and slick sheets.

For shingling, the distance of the rings 62 from the drive rollers 33 is preferably about one and one-half times the thickness of the paper being fed. The rings thus retard the overlying second sheet while having minimum contact with the underlying first sheet.

Where it is desired to have the sheet feeding apparatus feed groups of sheets of varying weights and thicknesses, it is necessary to adjust the nip spacing between the processing of each group to maintain the desired gap spacing at the nip. The above-described caliper assembly permits this adjustment to be made almost automatically, by slipping a shim 95 of predetermined thickness T between the two caliper jaws 85, 87 as shown in FIG. 5. For example, the device may initially be adjusted for a given sheet thickness, with the caliper jaws being closed, as seen in FIG. 4. Where sheets of a greater thickness are to be processed, a shim of predetermined thickness may be slipped between the caliper jaws by lifting the knob 83 upwardly so as to separate the caliper jaws, and then inserting the shim and releasing the knob so as to close the caliper jaws upon each other by the force of the spring 82. The shim then holds the roll 51 at a predetermined greater distance from the feed belts 30, which by design is appropriate for the second group of sheets.

In the drawings and specification, there has been disclosed a preferred embodiment of the invention and, although specific terms are employed, they are used in a generic and descriptive sense only and not for purposes of limitation, the scope of the invention being set forth in the following claims.

That which is claimed is:

1. An apparatus for serially feeding paper sheets in a forward direction from the bottom of a generally vertical stack of such sheets and comprising:

a frame, means mounted to said frame for supporting the generally vertical stack of sheets and so that the stack defines a forward side composed of aligned forward edges of the sheets, and a bottom, said supporting means including endless belt means and means rotatably mounting said endless belt means so as to have an upper run positioned to extend across the bottom of said stack;

drive means for rotating said endless belt means so that said upper run moves in the forward direction;

a gate forming member mounted to said frame and positioned above said upper run of said belt means and adjacent the forward side of said stack and so as to define a nip which forms a gap between said gate forming member and said upper run for permitting the lowermost sheet of the stack to pass forwardly from the stack through said nip, said gate forming member comprising a generally cylindrical roll defining a central axis and an outer peripheral surface which is concentric to said central axis, said outer peripheral surface having a plurality of annular grooves extending about the circumference thereof, with said annular grooves being concentric to said central axis, a relief extending axially along the length of said outer peripheral surface so as to intersect each of said grooves and with said relief positioned directly opposite said nip, and a rihg disposed in each of said grooves, with said rings being composed of a material having a higher coefficient friction than the material of said roll and being sized so as to be exposed on the portion of the outer peripheral surface defined by said relief and lying entirely within the grooves in the remaining portion of the outer peripheral surface so as to be non-exposed.

2. The apparatus as defined in claim 1 further comprising means adjustably mounting said gate forming member to said frame so as to permit the dimension of said nip to be adjusted, and whereby the gate forming member may be adjustably positioned so that the lowermost sheet is free to pass through said nip without significant engagement with said rings and thus without significant frictional resistance while the sheet immediately above the lowermost sheet engages said rings and is frictionally engaged thereby.

3. The apparatus as defined in claim 2 wherein said frame includes a mounting bracket which is positioned above said nip, and said means adjustably mounting said gate forming member comprises a rod fixed to said roll at a central portion thereof and such that the rod extends radially upwardly from said nip, and means interconnecting said rod to said mounting bracket so as to permit limited movement therebetween and to permit the dimension of said nip to be adjusted, and spring biasing means surrounding said rod for biasing said roll toward said nip and for permitting limited movement of said roll away from said nip and against the force of said spring biasing means.

4. The apparatus as defined in claim 3, wherein said means interconnecting said rod to said support bracket comprises caliper means including a knob threadedly mounted to the end of said rod opposite said roll, and such that rotation of said knob in one direction causes the rod and the roll to be lifted away from said nip and against the biasing force of the spring biasing means, and rotation in the other direction permits the rod and the roll to move toward said nip under the force of said spring biasing means.

5. The apparatus as defined in claim 4, wherein said caliper means further includes a pair of caliper jaws slideably mounted on said rod between said mounting bracket and said knob for permitting the knob and thus the rod and the roll to be lifted and held at a selected distance above said upper run of said endless belt means.

6. The apparatus as defined in claim 5, wherein said pair of caliper jaws comprises a lower caliper jaw slideably mounted upon said rod at a location above said mounting bracket, and an upper caliper jaw slideably mounted to said rod at a location between said lower caliper jaw and said knob, with said upper caliper jaw being secured to said knob so as to preclude relative movement in the direction of the rod while permitting relative rotation between said knob and said upper caliper jaw, and with said lower and upper caliper jaws overlying each other so that upon insertion of a shim therebetween, the caliper jaws are maintained in a spaced apart relation and the nip is held open by a corresponding distance.

7. An apparatus for serially feeding paper sheets in a forward direction from the bottom of a generally vertical stack of such sheets and comprising:

a frame including a mounting bracket, means mounted to said frame for supporting the generally vertical stack of sheets and so that the stack defines a forward side composed of aligned forward edges of the sheets, and a bottom, said supporting means including endless belt means and means rotatably mounting said endless belt means so as to have an upper run positioned to extend across the bottom of said stack;

drive means for rotating said endless belt means so that said upper run moves in the forward direction;

a gate forming member including a generally cylindrical roll, means adjustably mounting said gate forming member to said frame so that said roll is positioned above said upper run of said belt means and adjacent the forward side of said stack of sheets and so as to define a nip which forms a gap between said roll and said upper run, and such that the gate forming member may be adjustably positioned so that the dimension of said gap may be adjusted so that the lowermost sheet is free to pass through said nip without significant engagement with said roll while the sheet immediately above the lowermost sheet engages said roll and is frictionally engaged thereby, said adjustable mounting means comprising a rod fixed to said roll at a central portion thereof and such that the rod extends radially upwardly from said nip, and means interconnecting said rod to said mounting bracket of said frame so as to permit limited movement therebetween and to permit the dimension of said nip to be adjusted, and spring biasing means surrounding said rod for biasing said roll toward said nip and for permitting limited movement of said roll away from said nip and against the force of said spring biasing means, said adjustable mounting means further comprising caliper means including a knob threadedly mounted to the end of said rod opposite said roll, such that rotation of said knob in one direction causes the rod and the roll to be lifted away from said nip and against the force of the spring biasing means, and rotation in the other direction permits the rod and the roll to move toward said nip, under the force of said spring biasing means, said caliper means further including a pair of caliper jaws slideably mounted on said rod between said mounting bracket and said knob for permitting the knob and thus the rod and the roll to be lifted and held at a selected distance above said upper run of said endless belt means.

8. The apparatus as defined in claim 7, wherein said pair of caliper jaws comprises a lower caliper jaw slideably mounted upon said rod at a location above said mounting bracket, and an upper caliper jaw slideably mounted to said rod at a location between said lower caliper jaw and said knob, with said upper caliper jaw being secured to said knob so as to preclude relative movement in the direction of the rod while permitting relative rotation between said knob and said upper caliper jaw, and with said lower and upper caliper jaws overlying each other so that upon insertion of a shim therebetween, the caliper jaws are maintained in a spaced apart relation and the nip is held open by a corresponding distance.

9. A gate forming member for use with an apparatus for serially feeding paper sheets in a forward direction from the bottom of a generally vertical stack of such sheets and comprising:

a generally cylindrical roll defining a central axis and an outer peripheral surface which is concentric to said central axis, said outer peripheral surface having a plurality of annular grooves extending about the circumference thereof, with said annular grooves being concentric to said central axis, a relief extending axially along the length of said outer peripheral surface so as to intersect each of said grooves, and a ring disposed in each of said grooves, with said rings being composed of a material having a higher coefficient friction than the material of said roll and being sized so as to be exposed on the portion of the outer peripheral surface defined by said relief and lying entirely within the grooves in the remaining portion of the outer peripheral surface so as to be non-exposed.

10. The gate forming member as defined in claim 9, wherein said roll is composed of a material having a coefficient of friction of about 0.15 to 0.35, and said rings are composed of an elastomeric material having a coefficient of friction of about 0.5 to 0.7.

11. The gate forming member as defined in claim 9, wherein said roll includes a threaded radial opening at a central position along its axial length and opposite said relief for facilitating the mounting of said roll.

12. The gate forming member as defined in claim 11, wherein said roll further includes mounting posts extending from opposite ends of said roll and with said mounting posts being coaxially aligned with said central axis.

13. The gate forming member as defined in claim 9 wherein said relief is defined by a chordal line when viewed in cross section, and with the relief having a maximum depth which is at least equal to about one half the depth of said grooves.

14. The gate forming member as defined in claim 13 wherein roll is composed of a rigid plastic material and said rings are composed of an elastomeric material.

* * * * *